US006893232B2

(12) United States Patent
Wu

(10) Patent No.: US 6,893,232 B2
(45) Date of Patent: May 17, 2005

(54) HAND OPERABLE PUMP

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 183 days.

(21) Appl. No.: 10/375,436

(22) Filed: Feb. 27, 2003

(65) Prior Publication Data

US 2004/0169052 A1 Sep. 2, 2004

(51) Int. Cl.[7] ..... F04B 39/00
(52) U.S. Cl. ..... 417/547; 417/63; 417/555.1
(58) Field of Search ..... 417/547, 555.1, 417/552, 548, 63; 222/381

(56) References Cited

U.S. PATENT DOCUMENTS 2,649,335 A * 8/1953 Funke ..... 417/547
3,003,429 A * 10/1961 Petrusewicz et al. ..... 417/547
5,443,370 A * 8/1995 Wang ..... 417/238
5,489,197 A * 2/1996 Tsai ..... 417/526
6,017,201 A * 1/2000 Yang ..... 417/454
6,196,807 B1 * 3/2001 Wu ..... 417/63
6,716,006 B2 * 4/2004 Yang ..... 417/528

* cited by examiner

*Primary Examiner*—Charles G. Freay
(74) *Attorney, Agent, or Firm*—Alan D. Kamrath; Nikolai & Mersereau, P.A.

(57) ABSTRACT

An easily operable telescopic pump includes a first cylinder, a second cylinder, a grip and a nozzle. The second cylinder is inserted in the first cylinder. The grip is communicated with the second cylinder. The nozzle is communicated with the grip. A pipe extends through the grip and includes an end inserted in the second cylinder and an opposite end connected with the nozzle.

18 Claims, 6 Drawing Sheets

HAND OPERABLE PUMP

BACKGROUND OF INVENTION

1. Field of Invention

The present invention relates to a pump and, more particularly, to an easily operable hand pump.

2. Related Prior Art

There have been many portable pumps on the market. Most of them include a telescopic structure consisting of two or three sections so as to occupy limited space in storage and to pump great volume of air in a stroke in use. A typical three-sectional structure includes a first cylinder, a second cylinder inserted in the first cylinder and a third cylinder inserted in the second cylinder. In operation, a user grips the first cylinder with one hand and the third cylinder with the other hand. The user pulls the first cylinder and the second cylinder from the third cylinder in order to draw air into the pump. The user pushes the first cylinder and the second cylinder toward the third cylinder in order to discharge air from the pump. The first cylinder is often thick enough for the user to grip adequately. However, the third cylinder is often too thin for the user to grip adequately.

The present invention is therefore intended to obviate or at least alleviate the problem encountered in the prior art.

SUMMARY OF INVENTION

It is the primary objective of the present invention to provide an easily operable hand pump.

According to the present invention, an easily operable telescopic hand pump includes first cylinder, a second cylinder, a grip and a nozzle. The second cylinder is inserted in the first cylinder. The grip is communicated with the second cylinder. The nozzle is communicated with the grip.

The easily operable telescopic hand pump may include a pipe extending through the grip and including an end inserted in the second cylinder and an opposite end connected with the nozzle.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF PREFERRED EMBODIMENT

Figure 1:
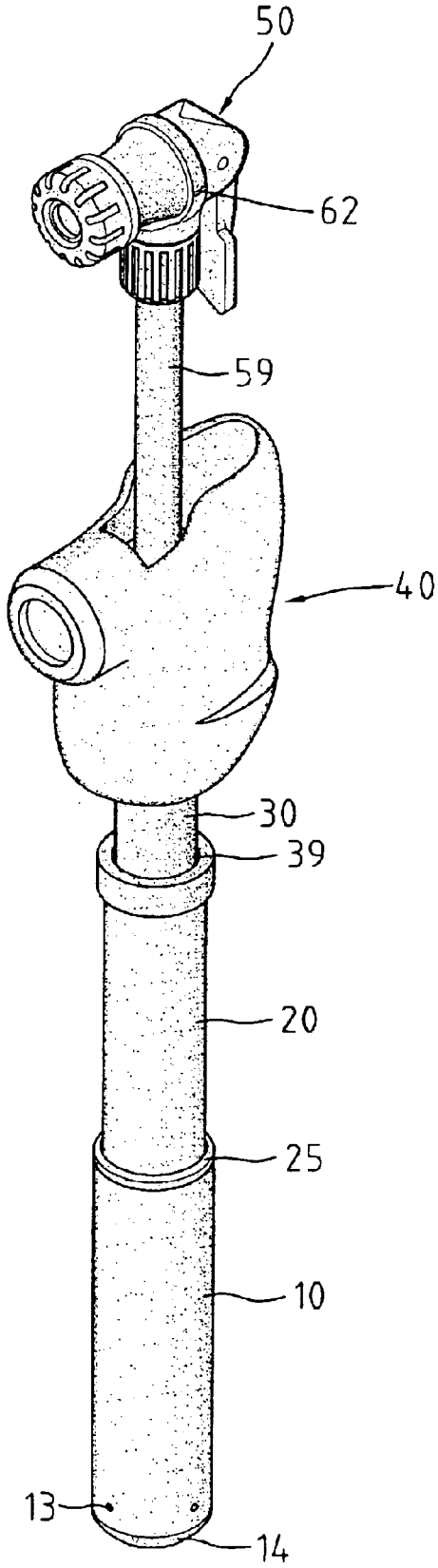
FIG. 1 is a perspective view of an easily operable pump in an extended position according to the preferred embodiment of the present invention.
Figure 2:
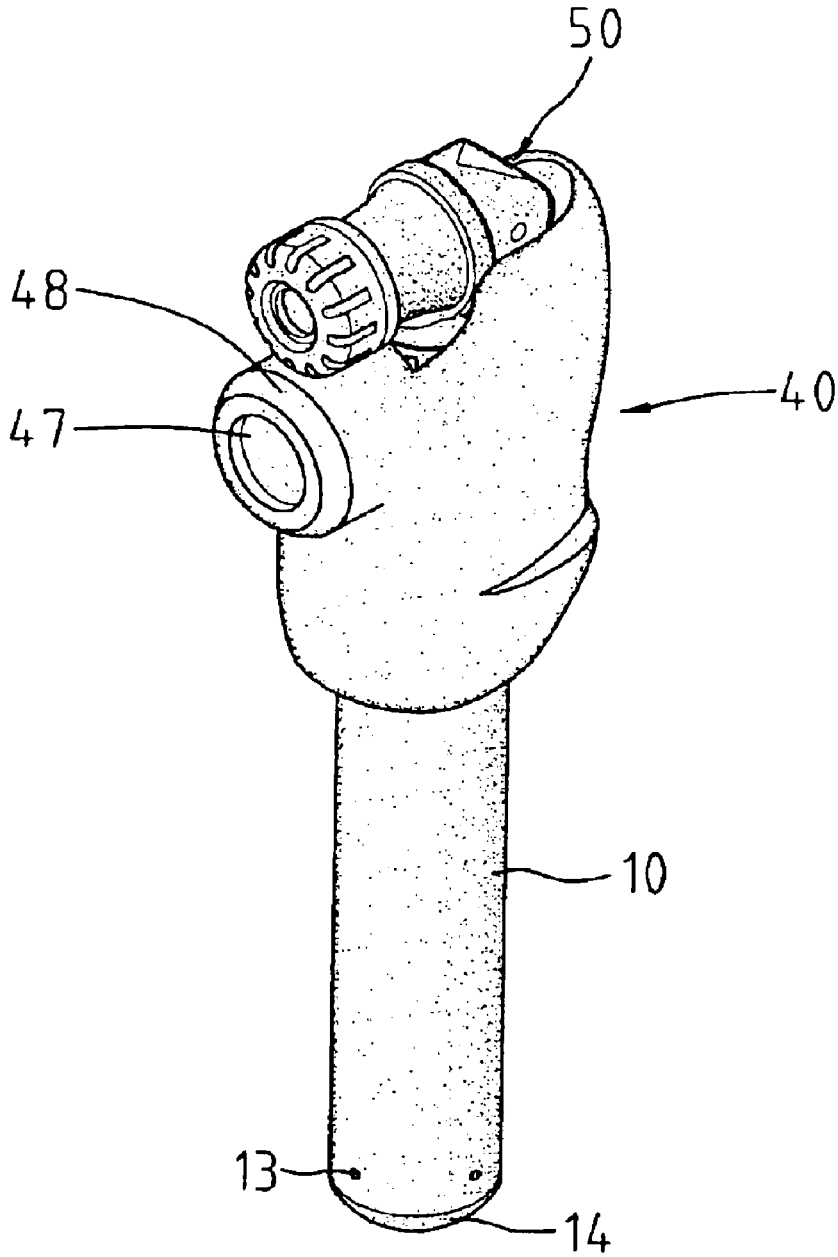
FIG. 2 is a perspective view of the easily operable pump in a retracted position according to the preferred embodiment of the present invention.
Figure 4:
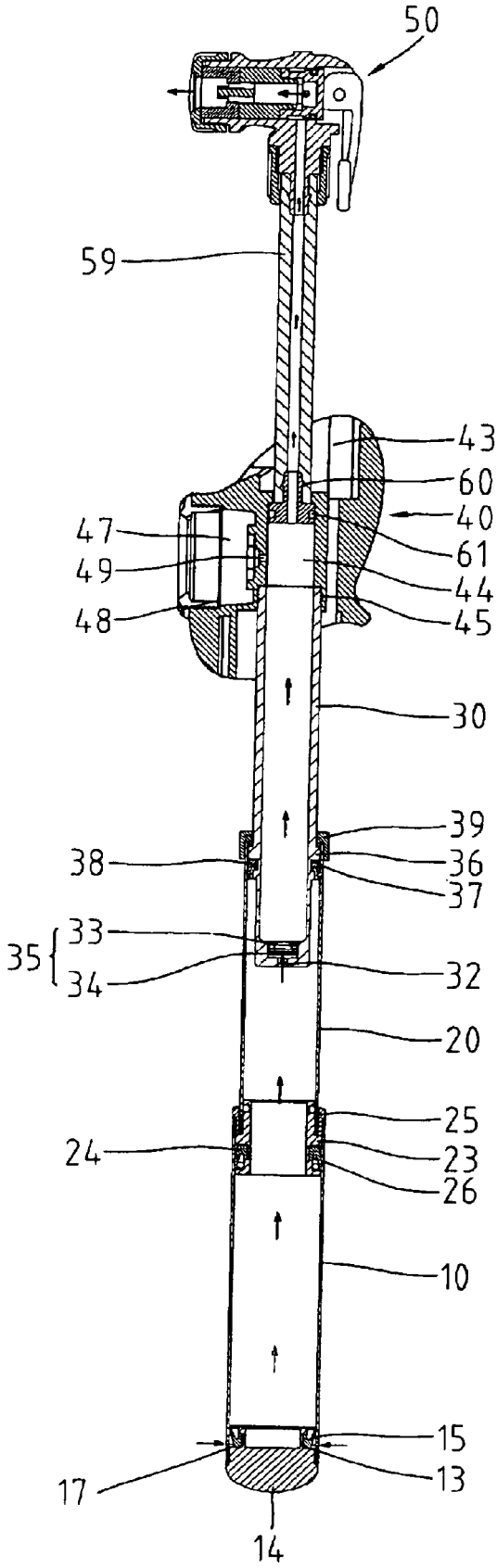
FIG. 4 is a cross-sectional view of the easily operable pump shown in FIG. 1.
Figure 5:
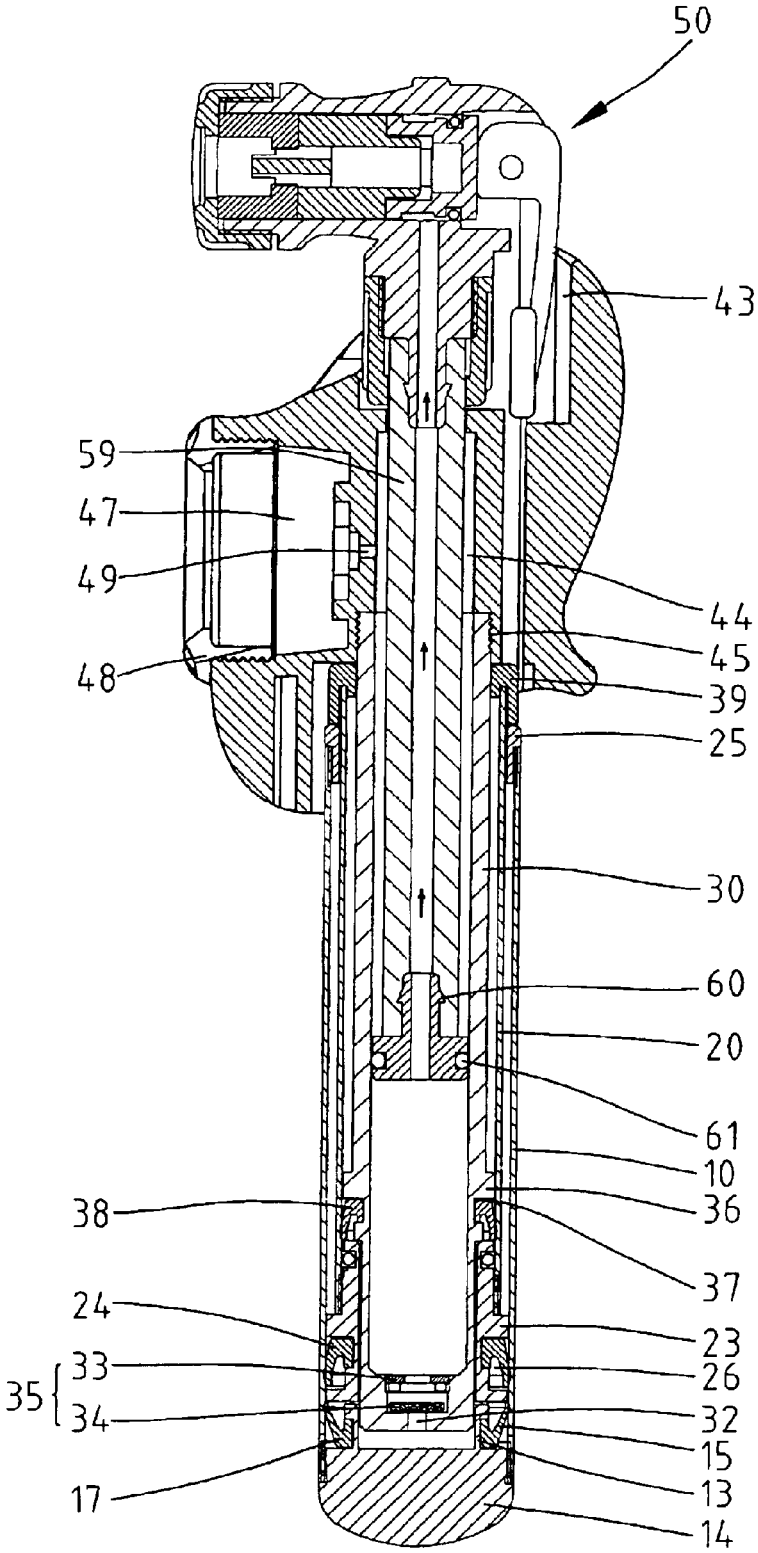
FIG. 5 is a cross-sectional view of the easily operable pump shown in FIG. 2.
Figure 6:
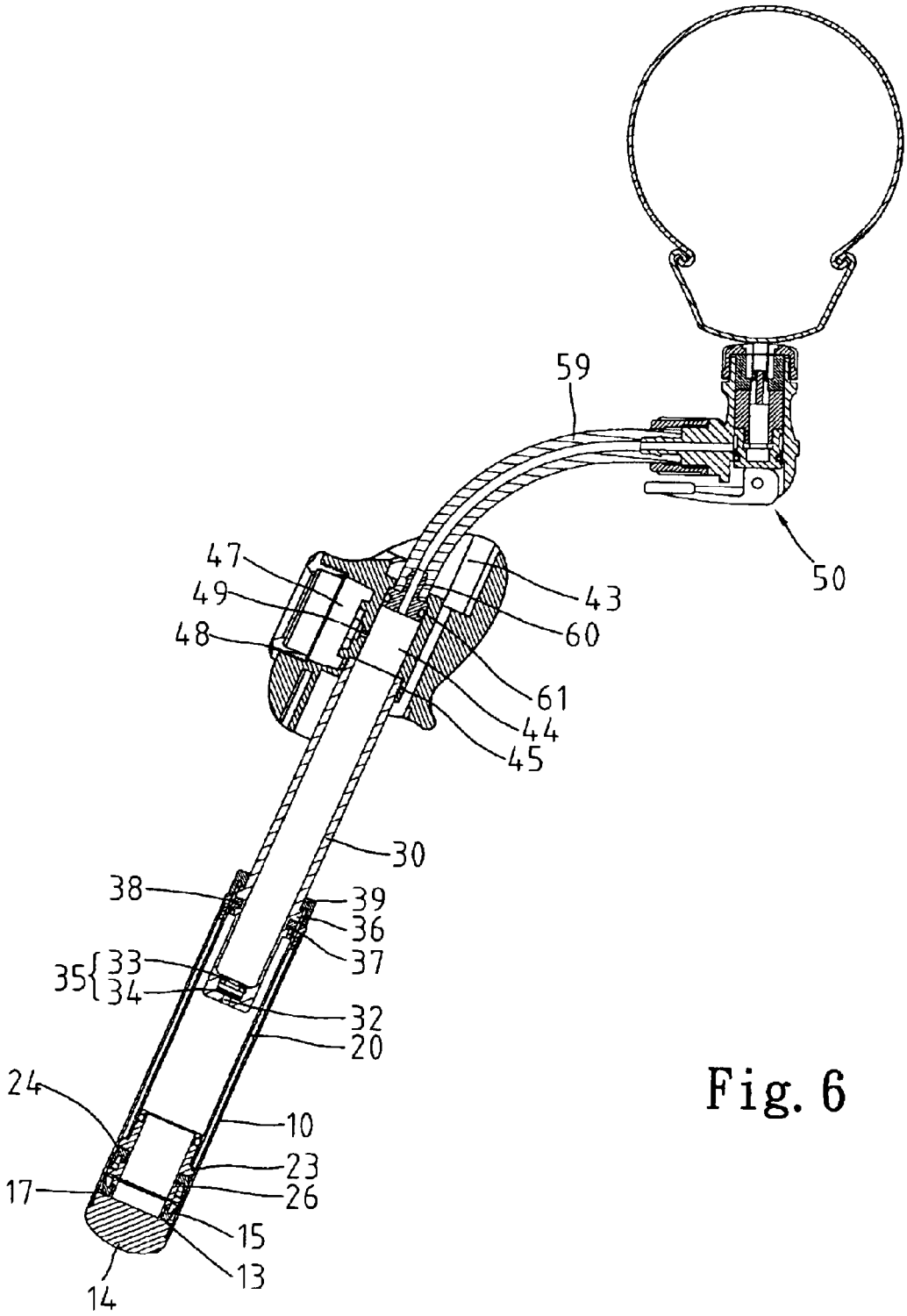
FIG. 6 is a cross-sectional view of the easily operable pump shown in FIG. 1 for pumping air into a tire.

Referring to the drawings, according to the preferred embodiment of the present invention, an easily operable pump includes a telescopic structure that is reciprocated between an extended position shown in FIGS. 1 and 4 and a retracted position shown in FIGS. 2 and 5 for pumping.

Figure 3:
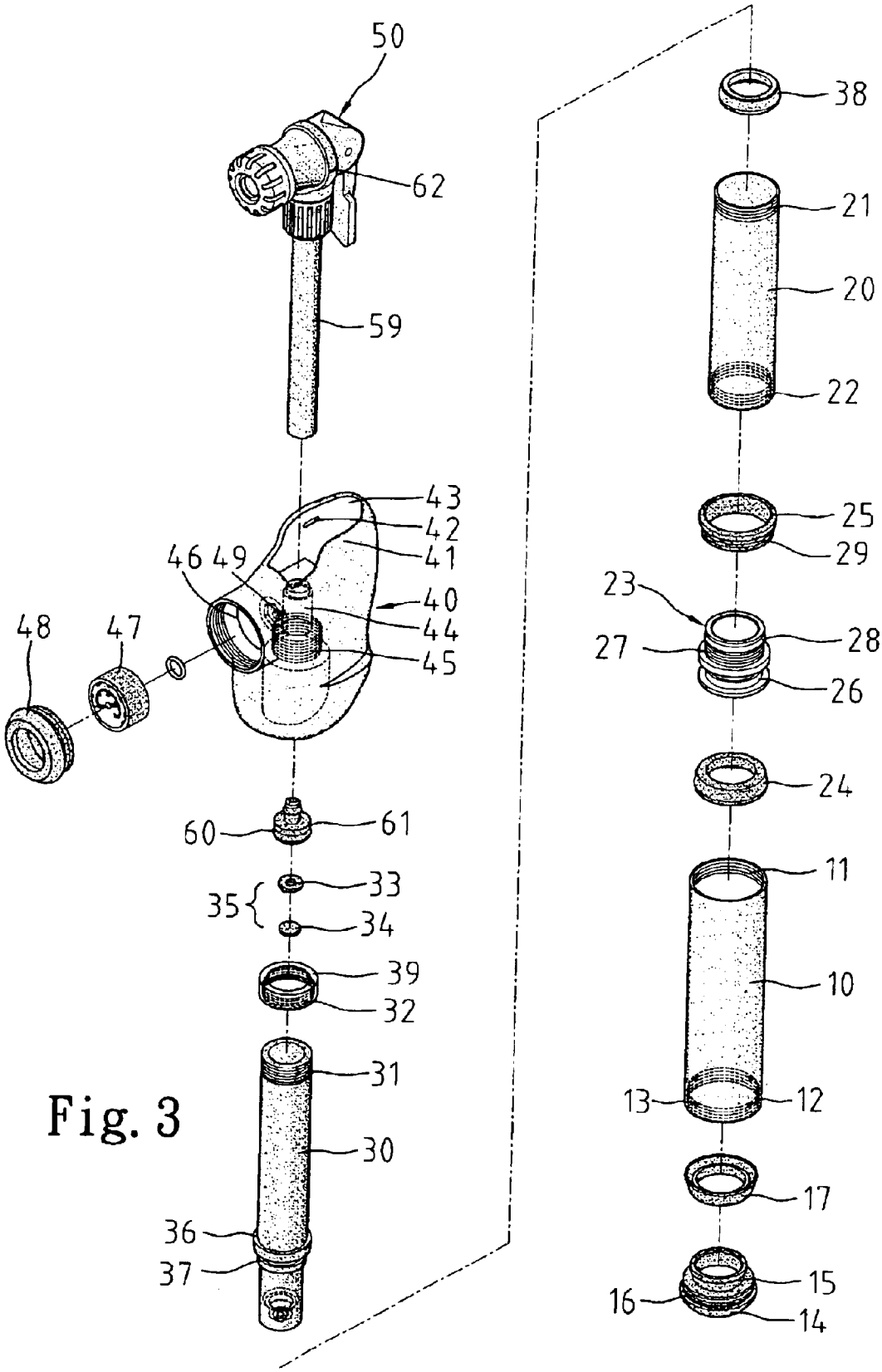
FIG. 3 is an exploded view of the easily operable pump shown in FIGS. 1 and 2.

Referring to FIG. 3, the easily operable pump includes a first cylinder 10, a second cylinder 20 inserted in the first cylinder 10, a third cylinder 30 inserted in the second cylinder 20, a grip 40 mounted on the third cylinder 30, a pipe 59 inserted in the third cylinder 30 and a nozzle 50 connected with the pipe 59.

The first cylinder 10 includes an external side and an internal side. A thread 11 is formed at an upper end of the internal side of the first cylinder 10. A thread 12 is formed at a lower end of the internal side of the first cylinder 10. In the lower end of the first cylinder 10 are defined four inlets 13.

A check valve 17 is used for control opening and closing of the inlets 13. The check valve 17 includes an internal annular portion and an external annular portion spreading from the internal annular portion.

The lower end of the first cylinder 10 is closed via a cover 14. The cover 14 includes a first section, a second section larger than the first section and a third section larger than the second section. The first section of the cover 14 defines an annular groove 15. The second section of the cover 14 includes a thread 16 formed thereon.

The internal annular portion of the check valve 17 is positioned in the annular groove 15 of the cover 14. The thread 16 of the cover 14 is engaged with the thread 12 of the first cylinder 10. The external annular portion of the check valve 17 is for contact with the internal side of the first cylinder 10. As the first cylinder 10 is moved toward the extended position shown in FIGS. 1 and 4, air flows between the internal side of the first cylinder 10 and the external annular portion of the check valve 17. As the first cylinder 10 is moved toward the retracted position shown in FIGS. 2 and 5, air pushes the external annular portion of the check valve 17 against the internal side of the first cylinder 10, thus avoiding the air flowing between the internal side of the first cylinder 10 and the external annular portion of the check valve 17.

The second cylinder 20 includes an external side and an internal side. A thread 21 is formed on the external side of the second cylinder 20 at an upper end. A thread 22 is formed on the internal side of the second cylinder 20 at a lower end.

An annular piston 23 includes an annular groove 26 defined therein near a lower end thereof and a thread 27 formed thereon. A ring 28 is mounted on the upper end of the annular piston 23.

A seal 24 is provided. In the preferred embodiment, the seal 24 is shaped similar to the check valve 17 but located in an opposite direction. That is, the seal 24 includes an internal annular portion and an external annular portion spreading from the internal annular portion. However, the seal 24 may be a simple ring in another embodiment.

The internal annular portion of the seal 24 is put in the annular groove 26 of the annular piston 23. The second cylinder 20 is inserted in the first cylinder 10. The thread 27 of the annular piston 23 is engaged with the thread 22 of the second cylinder 20. A ring 25 is formed with a thread 29 engaged with the thread 11 of the first cylinder 10.

The third cylinder 30 includes an external side and an internal side. On the external side of the third cylinder 30 are formed a thread 31 and a ring 36. In the external side of the third cylinder 30 is defined an annular groove 37.

A seal 38 is provided. In the preferred embodiment, the seal 38 is shaped and positioned similar to the seal 24. That is, the seal 38 includes an internal annular portion and an external annular portion spreading from the internal annular portion. However, the seal 38 may be a simple ring in another embodiment.

A ring 39 includes an external side and internal side. A thread 32 is formed on the internal side of the ring 39.

In a lower end of the third cylinder 30 is installed a check valve 35 consisting of a ring 33 and a disc 34 located below the ring 33. The internal annular portion of the seal 38 is put in the annular groove 37. The third cylinder 30 is inserted in the second cylinder 20. The thread 32 of the ring 39 is engaged with the thread 21 of the second cylinder 20. The ring 39 is for engagement with the ring 36 in order to retain the third cylinder 30 in the second cylinder 20.

A grip 40 is mounted on the third cylinder 30. The grip 40 includes an ergonomic profile so that a user can readily and comfortably hold it. A seat 41 is formed on an upper end of the grip 40. The seat 41 defines a space 43. Two recesses 42 are defined in the wall of the space 43, i.e., an internal side of the seat 41. The grip 40 defines a longitudinal space 44 communicated with the space 43. A thread 45 is formed on the wall of the longitudinal space 44. The grip 40 defines a lateral space 46 communicated with the longitudinal space 44 through a channel 49. A pressure gauge 47 is installed in the lateral space 46. A thread formed on a ring 48 is engaged with a thread formed on the wall of the lateral space 46. Thus, the pressure gauge 47 is retained in position.

The pipe 59 is inserted through the space 43 into the longitudinal space 44. The pipe 59 is a flexible pipe in the preferred embodiment; however, it may be a rigid pipe in another embodiment. An annular piston 60 includes a reduced end fit in an end of the pipe 59, thus avoiding the pipe 59 from being disengaged from the grip 40. The thread 45 of the grip 40 is engaged with the thread 31 of the third cylinder 30. A ring 61 is mounted on the annular piston 60 for engagement with the internal side of the third cylinder 30. The nozzle 50 is attached to an opposite end of the pipe 59.

The nozzle 50 is formed with two bosses 62. When the pipe 59 is retracted into the third cylinder 30, the bosses 62 of the nozzle 50 are inserted in the recesses 42 of the seat 41. Thus, the nozzle 50 is retained in the seat 41, i.e., the pipe 59 is retained in the third cylinder 30.

The present invention has been described via illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A hand operable telescopic pump including:

a first cylinder;

a second cylinder inserted in the first cylinder;

a grip communicated with the second cylinder;

a nozzle communicated with the grip; and a pipe extending through the grip and including an end inserted in and retractable into the second cylinder and an opposite end connected with the nozzle, wherein the grip includes a seal formed thereon for receiving the nozzle when the pipe is retracted into the second cylinder.

2. The hand operable telescopic pump according to claim 1 including a pressure gauge installed on the grip.

3. The hand operable telescopic pump according to claim 2 wherein the grip includes an ergonomic profile so that a user can readily and comfortably hold it.

4. The hand operable telescopic pump according to claim 1 wherein the pipe is a flexible pipe.

5. The hand operable telescopic pump according to claim 1 wherein the seat defines a space for receiving the nozzle.

6. The hand operable telescopic pump according to claim 5 wherein the seat includes at least one recess defined in a wall of the space, and the nozzle is formed with at least one boss for insertion in the recesses of the seat in order to retain the nozzle in the seat.

7. The hand operable telescopic pump according to claim 6 wherein the grip defines a longitudinal space for receiving the second cylinder.

8. The hand operable telescopic pump according to claim 7 including a pressure gauge, wherein the grip defines a lateral space communicated with the longitudinal space in order to receive the pressure gauge.

9. The hand operable telescopic pump according to claim 1 wherein the grip includes an ergonomic profile so that a user can readily and comfortably hold it.

10. A hand operable telescopic pump including:

a first cylinder;

a second cylinder inserted in the first cylinder;

a third cylinder inserted in the second cylinder;

a grip communicated with the third cylinder;

a nozzle communicated with the grip; and a pipe extending through the grip and including an end inserted in and retractable into the third cylinder and an opposite end connected with the nozzle, wherein the grip includes a seat formed thereon for receiving the nozzle when the pipe is retracted into the third cylinder.

11. The hand operable telescopic pump according to claim 10 including a pressure gauge installed on the grip.

12. The hand operable telescopic pump according to claim 11 wherein the grip includes an ergonomic profile so that a user can readily and comfortably hold it.

13. The hand operable telescopic pump according to claim 10 wherein the pipe is a flexible pipe.

14. The hand operable telescopic pump according to claim 10 wherein the seat defines a space for receiving the nozzle.

15. The hand operable telescopic pump according to claim 14 wherein the seat includes at least one recess defined in a wall of the space, and the nozzle is formed with at least one boss for insertion in the recesses of the seat in order to retain the nozzle in the seat.

16. The hand operable telescopic pump according to claim 15 wherein the grip defines a longitudinal space for receiving the third cylinder.

17. The hand operable telescopic pump according to claim 16 including a pressure gauge, wherein the grip defines a lateral space communicated with the longitudinal space in order to receive the pressure gauge.

18. The hand operable telescopic pump according to claim 10 wherein the grip includes an ergonomic profile so that a user can readily and comfortably hold it.

* * * * *